United States Patent [19]

Herwig

[11] Patent Number: 4,873,906

[45] Date of Patent: Oct. 17, 1989

[54] ADJUSTABLE STRINGPLATE MOUNTING MEANS FOR A GRAND PIANO

[76] Inventor: Lewis F. Herwig, 4417 E. Hearn Rd., Phoenix, Ariz. 85032

[21] Appl. No.: 313,046

[22] Filed: Feb. 21, 1989

[51] Int. Cl.[4] ..... G10C 3/04

[52] U.S. Cl. ..... 84/184

[58] Field of Search ..... 84/184, 185, 187, 188

[56] References Cited

U.S. PATENT DOCUMENTS 197,332 11/1877 Chickering ..... 84/184

3,437,000 4/1969 Goodlander ..... 84/188

*Primary Examiner*—L. T. Hix

*Assistant Examiner*—Brian W. Brown

*Attorney, Agent, or Firm*—Nelson & Roediger

[57] ABSTRACT

Adjustable mounting means for providing variable spacing between the stringplate and the adjacently spaced soundboard of a grand piano wherein a number of elongate threaded cylinders are located in the peripheral frame is disclosed. Each threaded member has an upwardly extending end for receiving the apertured string plate thereon and contains a central threaded bore for receiving a bolt. The stringplate rests on the threaded members with the appropriate spacing between soundboard and stringplate being attained by adjustment of the threaded members from the underside of the piano.

6 Claims, 1 Drawing Sheet

ADJUSTABLE STRINGPLATE MOUNTING MEANS FOR A GRAND PIANO

BACKGROUND OF THE INVENTION

This invention relates to an adjustable mounting means for controlling and permitting modification of the spacing between the stringplate and the adjacently-spaced soundboard of a musical instrument, such as a piano.

In the construction of a piano, the stringplate, to which the opposite ends of the strings struck by the hammers are fastened, is maintained in a spaced relation to an adjacently-spaced soundboard. The stringplate is subjected to enormous torsional and compressive forces since a multiplicity of strings of varying tensions are affixed to opposite ends thereof. As a result, the stringplate is typically a cast iron member of substantial thickness and weight to ensure that it does not experience significant dimensional changes or warping over a long period of time. Dimensional changes are likely to alter the tones produced during use thus producing a lower-quality sound and may only be partially compensated for by retuning the string tension.

The conventional stringplate is provided with a number of different openings which permit bridges contained on or mounted against the adjacent soundboard to extend through the plane of the stringplate and thereby contact the strings. The contact of the bridges with the strings produces a departure from a linear string position. The relationship between the location of the bridges between ends of the strings, the number of strings associated with each bridge and the spacing between the adjacent bridges has been the study of many craftsmen for a long period of time. These relationhips are fixed once the design of the piano is completed. However, different environmental conditions along with any movement of the piano may result in an undesired change in the tension of the strings. This verification can result from the changes in the stringplate itself, dimensional changes in either the soundboard which supports the bridges or the frame, or a combination of these factors. However, it is important to note that these frequently unpredictable variations adversely affect performance and that compensation techniques should be used as a result of these changes. In practice the resultant impact on the sounds produced by the individual strings cannot always be corrected by adjusting individual string tension and may require removal of the stringplate from the piano frame in certain instances.

The peripheral frame is an integral part of any piano and its design is such as to ensure that the substantial weight of the stringplate can be borne for the useful life of the piano. In addition to supporting the stringplate, the frame provides support for the soundboard which is firmly affixed thereto about its periphery. In order to establish uniform spacing between stringplate and soundboard during manufacture, it has been common to provide spacers between the stringplate and the underlying soundboard. These spacers are subjected to compressive forces over a long period of time and may themselves change dimension which further exacerbates the problems noted above.

In addition, the spacing between the strings and the underlying soundboard determines in part the tone produced by each string and this spacing should be precisely maintained over long periods of time in order to provide a reliable musical instrument. Variations in the stringplate or soundboard dimensions or their relative positions across the entire large area surfaces thereof will produce different tones and sound quality when the strings are vibrated. Thus, a means of compensation is needed to ensure that the effects of these changes can be reversed and the original or better tone quality is restored or improved.

The difficulties encountered with the use of spacers distributed about the periphery of the stringplate and resting on the underlying support frame are discussed in U.S. Pat. No. 3,437,000 which is directed to a means for mounting the stringplate in a predetermined space relation to the support frame. This patent teaches the use of bolts which are threaded into the stringplate and the adjacently spaced portions of the underlying frame for stringplate support. The stringplate is maintained initially at the desired height by the use of intermediate spacers in combination with the bolts threaded through tapped holes in the stringplate and into the underlying frame. The bolts are turned until the heads thereof rest firmly against the exposed surface of the stringplate. Thus, the height of the stringplate over the combination of sounding board and frame is determined by the spacers or supports positioned prior to the lowering of the stringplate into position in the piano. The bolts are not suited for later adjustment of the height of the stringplate as the spacing is determined by the blocks which may be left in place or removed, according to the reference. When the mounting is completed, the stringplate is out of contact with the soundboard and supported, at least initially, in the proper position about its periphery. This method of construction provides one mode of assembly for a grand piano, but it does not permit any later adjustment to compensate for variations provided by changes in location of the piano, different environmental conditions as affecting on the plurality of the stringplate or the spacing between the plate and the adjacent soundboard. In summary, this reference teaches establishing a one-time fixed relationship between frame-soundboard combination and the adjacently-spaced stringplate which cannot be readily modified without disassembling the entire piano structure.

Accordingly, it is an object of the present invention to provide a positive means for supporting a stringplate in spaced relationship to the soundboard and to do so in a manner which permits modification of the spacing at different points about the periphery of the stringplate to compensate for changing conditions. In addition, this invention is directed to a mounting means which permits localized adjustment with the adjustments being made from the underside of the piano. The adjustments provided by the present invention are bidirectional in the sense that both increasing and decreasing of the spacing between stringplate and soundboard can be readily accomplished in localized areas, as necessary. Furthermore, the physical support of the stringplate does not rely on the load bearing capability of tapped apertures in the stringplate, but rather utilizes relatively large area support regions adjacent the apertures of the stringplate and located on the undersurface thereof.

SUMMARY OF THE INVENTION

The present invention relates to a mounting means for an apertured stringplate in a musical instrument wherein the stringplate is spaced from a soundboard which aids in providing the desired musical tones when the instrument is in use.

In the present invention, the mounting means for the stringplate includes a plurality of elongated threaded members which are spaced about the frame and individually movably positioned within the frame. Each threaded member has first and second ends. The first end of the elongate threaded member extends through the frame and the soundboard mounted thereon and is adapted to receive placement of the stringplate thereon. The stringplate contains a plurality of apertures spaced about its periphery to receive fastening means. The elongate threaded members are located in the frame in registration with the stringplate apertures. When the threaded members are inserted into the frame, preferably from the underside thereof, the position of the first end in relation to the frame and soundboard combination is determined by the amount of rotation imparted to the elongate means.

The first end of each elongate member contains a receiving bore which is threaded to receive a fastener extending downwardly through the corresponding aperture in the stringplate. The fastener is inserted in the receiving bore in the first end of each elongate member after the elongate threaded members are adjusted to their proper height in support of the stringplate. The second end of each threaded member contains means for promoting movement of the threaded members in relation to the frame and is typically an external tool-gripable hexagonal head or an internal receiving hexagonal countersink for use with an Allen wrench.

Access to the second end of each of the elongate threaded members is from the underside of the piano. When the stringplate is positioned on the first ends of the elongate members with the strings passing across the top surface of the bridges extending through the passageways in the stringplate so as to contact the multiplicity of strings extending thereacross, the elongate threaded members can be individually adjusted to provide the appropriate spacing between stringplate and soundboard. Following the overall positioning, the fastening means are then inserted through the apertures in the stringplate and threaded into the receiving means to firmly affix the stringplate against the first end of the elongate threaded means.

Since conditions over a period of time typically cause the attitude of the stringplate to vary somewhat in relation to the soundboard, it frequently becomes necessary to readjust the spacing between stringplate and soundboard so that the tonal quality of the musical instrument can be restored to its original or improved performance level. This is readily accomplished by removal of the fastening means, or if not total removal, the partial back-threading of the fastening means in the first end of the elongate threaded members. Next, the appropriate tool is used to engage the second end of the threaded member from beneath the piano with rotational forces applied in either direction to restore the original spacing or to alter the spacing between stringplate and soundboard. Following adjustment to the second end of some or all of the elongate threaded members, the fastening means are again urged into secure contact with the stringplate thereby placing it firmly against the first ends. It is to be noted that the entire adjustment can be done without removing the stringplate from the instrument and that the adjustment can provide both an increase or decrease in the spacing about all or merely a portion of the periphery of the frame based upon the correction desired.

Further features and advantages will become more readily apparent from the following detailed description when viewed in conjunction with the accompanying drawings.

DESCRIPTION OF THE PREFERRED EMBODIMENT

Figure 1:
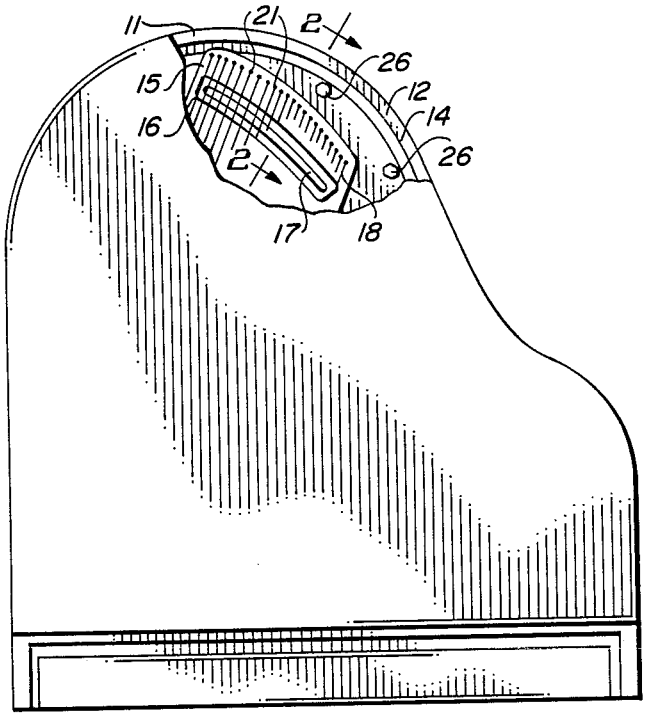
FIG. 1 is a plan view of a grand piano with a portion of the top cover broken away to show the relationship between strings, bridge and stringplate.
Figure 2:
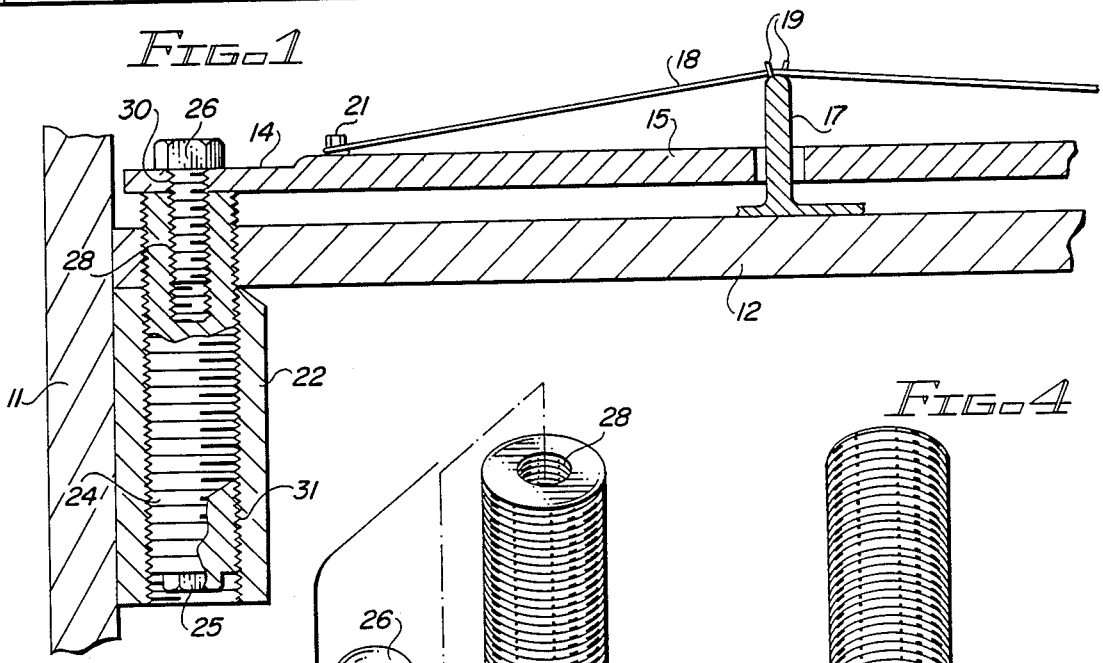
FIG. 2 is a view in partial section taken along line 2—2 of FIG. 1.

Referring now to FIG. 1, a piano is shown in plan view with a portion of the top cover or lid broken away to reveal the constructional relationship of the frame, soundboard and stringplate. As shown, the outer frame 11 extends about the inner workings of the piano. An inner frame 22, seen in FIG. 2, is affixed to the vertical inner surface of outer frame 11 and provides the support for the stringplate 14 and the underlying soundboard 12. The hexagonal bolts 26 shown in FIG. 1 denote the location of the peripheral apertures which receive these fastening bolts and secure the stringplate to the inner frame.

The stringplate 14 is typically a cast-iron plast weighing several hundred pounds is formed to and contain surface regions that are raised in certain areas and depressed in other areas. Also, the stringplate includes a plurality of slotted openings for enhancement of the tonal quality of the instrument. The configuration of the stringplate and the placement of fastening pins for the different strings 18 extending thereacross along with the particular location of the slots to receive the bridges 17 which extend upwardly therethrough to contact the strings and provide the desired tension are often varied in accordance with the manufacturers standards for this type and size piano. The configuration of the central region of the stringplate is not part of the present invention.

In the embodiment of FIG. 1, a raised section 15 of the stringplate 14 is shown having a curved opening or slot 16 with bridge 17 passing upwardly therethrough to contact the underside of adjacent strings. The bridge 17 and the upwardly-extending angled pins 19 through which the strings are entwined control in part the tension of the strings by urging the strings upward from the horizontal as seen more clearly in FIG. 2. As shown the stringplate is provided with terminal pins 21 for receiving and securing the end of the strings which are distant from the conventional keyboard located at the front of the piano. A variety of different methods of securing the forward most ends of the strings are used by different manufacturers. The normal approach is to provide a pin block extending along the front of the piano which is then affixed to the piano frame. Alternatively, the block receiving the pins may be secured to the stringplate itself. However, the present invention deals with the securing of the stringplate to the frame of the piano about its periphery and is not directly concerned with the manner of attachment of the strings to either the stringplate or a pin block located proximate the keyboard.

The constructional features of the present invention are shown more clearly in the cross sectional view of FIG. 2 wherein the inner frame 22 is secured to the outer frame 11. The soundboard 12 is affixed to both the top of the inner frame 22 and the inner wall of the outer frame 11, typically by means of an adhesive since all three parts are formed of wood. The soundboard 12 extends across the width of the piano to threreby contact the inner frame about the periphery of the main portion of the piano with the exception of the keyboard region. Bridges 17 are mounted securely on the soundboard and extend upwardly through the openings in the metal stringplate. One example is shown extending through curved opening 16 in the stringplate 14. The bridge 17 contacts the adjacent strings and urges them upwardly to a desired attitude and tension. The effect of a bridge on the adjacent strings is determined by the spacing between soundboard and stringplate at that particular location in the piano. By varying the spacing, the tension in the strings contacted is varied accordingly.

The inner frame 22 and the soundboard 12 are provided with a plurality of threaded bores 31 at different locations spaced about the periphery of the piano. These bores are positioned in alignment with the holes 30 formed in the stringplate at the time of casting. In the embodiment of FIG. 2, the hole 30 is shown tapped but as will later be explained, not all embodiments of the invention need to utilize a tapped series of stringplate holes to practice the present invention.

Figure 3:
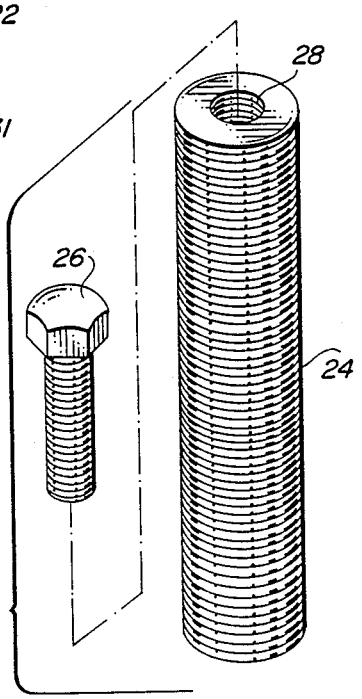
FIG. 3 is a view in perspective of an elongate threaded member with the first end shown.
Figure 4:
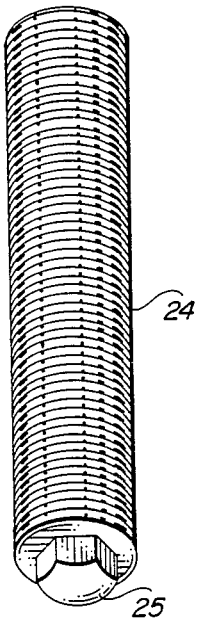
FIG. 4 is a perspective view showing the second end of the elongate threaded means of FIG. 3.

Each of the threaded bores in the inner frame and adjacent soundboard are provided with a elongate cylindrical member which is externally threaded and provided with a hexagonal head 25 so that it may be readily driven upward from the bottom of the inner frame and thereby protrude above the soundboard. The first end of the elongate member is provided with a central threaded bore 28 that is sufficiently deep so that it can receive a fastening means 26 extending downwardly from the top of the stringplate 14. An elongate member is shown in further detail in FIGS. 3 and 4 wherein the central threaded bore 28 and the fastening bolt 26 are shown.

When the piano is being assembled, the stringplate is positioned in the appropriate position overlying the soundboard affixed to the inner frame 22. The apertures 30 in the stringplate are used as a templet to determine the precise locations of the threaded bores to be formed in the inner frame and soundboard. The stringplate is then removed, preferably after pilot holes have been drilled, so that the bores can then be formed in the inner frame. The cylindrical member may tap the holes as they are inserted from the bottom if desired or the use of a separate tap may be employed. In either case, the cylindrical member 24 is threaded into the central bore so that its first end protrudes above the soundboard 12. This process is repeated at each location about the periphery of the piano. A threaded cylindrical member 24 is then threaded sufficiently far into the bore so that the first end provides the specified initial spacing for the stringplate when placed thereon. The placement of the stringplate initially may require slight adjustments in different ones of the cylindrical members. This is readily accomplished by the use of a socket wrench placed upon the hexagonal end 25 or an Allen wrench if a hexagonal countersink is provided.

When the spacing has been adjusted across the plane of the stringplate, the threaded fasteners 26 are inserted in the apertures of the stringplate and threaded into the central bore of each elongate member. These fasteners are tightened against the stringplate and, in the case of the embodiment wherein the stringplate aperture is threaded, prevent any relative movement in either the vertical or horizontal direction between the stringplate and the end of the cylindrical member. Furthermore, the threaded fastener when urged against the stringplate inhibits rotation of the cylindrical member in the threaded bore in the inner frame so that the spacing is maintained during continued operation of the piano. However, different environmental conditions and changing locations of the piano may result in a variation in the spacing between stringplate and soundboard in the region proximate to one or more of the cylindrical member. This can be readily compensated for in the case of the present invention by a removal of one or more of the fasteners 26 combined with the rotation of the corresponding cylindrical members in the appropriate direction to either expand or contract the spacing at this localized region. The important aspect of this invention is that this adjustment can be made at one or more locations in the piano without requiring the removal and resetting of the stringplate. Furthermore, the adjustment can be made by the use of a wrench employed at the underside of the piano thus limiting the possibility of damage of the strings, bridges or surfaces of the piano itself.

By utilizing the cylindrical member 24 as the support means for the stringplate 14 and thereby providing a construction whereby the rotation of selected cylindrical members permits adjustment of the spacing between stringplate and soundboard in either direction, the use of individual peripheral supports or spacers which may not have the ability to maintain their desired spacing dimensions over long periods and under different operating conditions is eliminated. While the above description has referred to a specific embodiment of the invention, it is to be noted that many modifications and variations may be made therein without departing from the scope of the invention as claimed.

What I claim is:

1. In a musical instrument having a sound board affixed to a frame with an apertured stringplate mounted thereover, the improvement which comprises:

(a) elongate threaded means for movably engaging the frame and having first and second ends, the first end of said elongate threaded means extending through the soundboard for placement of the stringplate thereon;

(b) receiving means contained in the first end of said elongate means and aligned with an aperture in the stringplate, and (c) fastening means extending through the aperture in said stringplate into said receiving means for urging said stringplate thereagainst, the rotation of said elongate means providing adjustment of the spacing between the stringplate and the soundingboard.

2. The invention in accordance with claim 1 further comprising means for promoting movement of the elongate threaded means in relations to the frame and affixed to the second end of said threaded means.

3. The invention in accordance with claim 2 wherein said elongate means is an externally-threaded cylindrical member.

4. The invention in accordance with claim 3 wherein said receiving means is an internally-threaded bore provided in the first end of the cylindrical member.

5. The invention in accordance with claim 4 wherein said fastening means is a threaded bolt.

6. The invention in accordance with claim 5 wherein said means for promoting movement of the elongate threaded means in relation to the frame comprises a plurality of flattened tool-receiving regions proximate to the second thereof.

* * * * *